US006615599B1

(12) United States Patent
Pettitt et al.

(10) Patent No.: US 6,615,599 B1
(45) Date of Patent: Sep. 9, 2003

(54) THERMOSTATIC EXPANSION VALVE AND AIR CONDITIONING SYSTEM FOR LOW REFRIGERANT CHARGE

(75) Inventors: Edward Douglas Pettitt, Burt, NY (US); John Paul Telesz, East Amherst, NY (US); Jing Zheng, Williamsville, NY (US)

(73) Assignee: Delphi Technologies Inc., Troy, MI (US)

( * ) Notice: Subject to any disclaimer, the term of this patent is extended or adjusted under 35 U.S.C. 154(b) by 0 days.

(21) Appl. No.: 10/183,230

(22) Filed: Jun. 26, 2002

(51) Int. Cl.[7] ..... F25B 41/04
(52) U.S. Cl. ..... 62/197; 236/92 B
(58) Field of Search ..... 62/197, 222, 224, 62/225; 236/92 B

(56) References Cited

U.S. PATENT DOCUMENTS 4,936,108 A * 6/1990 Ogawa et al. ..... 62/197
4,986,085 A * 1/1991 Tischer ..... 62/225
5,026,022 A 6/1991 Bastle ..... 251/122
6,185,959 B1 2/2001 Zajac ..... 62/527
6,233,956 B1 * 5/2001 Katayama et al. ..... 62/197
6,321,995 B1 11/2001 Badovick et al. ..... 236/92 B
6,354,510 B1 * 3/2002 Petersen ..... 236/92 B

* cited by examiner

*Primary Examiner*—William E. Tapolcai
(74) *Attorney, Agent, or Firm*—Patrick M. Griffin

(57) ABSTRACT

A thermostatic expansion valve controls a flow of refrigerant. The valve includes a body defining a fluid chamber. A refrigerant inlet is defined within the body. The inlet communicates with the chamber such that the refrigerant can flow through the inlet and into the chamber. First and second outlets are defined within the body. The first outlet communicates with the chamber such that the refrigerant can flow from the chamber to an evaporator during normal and low refrigerant charge. The second outlet communicates with the chamber such that the refrigerant can flow from the chamber to a compressor during low charge. A moveable needle controls the flow of the refrigerant into and out of the body. A notch is defined within the needle such that, during low charge, the refrigerant that flows into the chamber can flow to the second outlet and to the compressor without flowing through the evaporator.

35 Claims, 6 Drawing Sheets

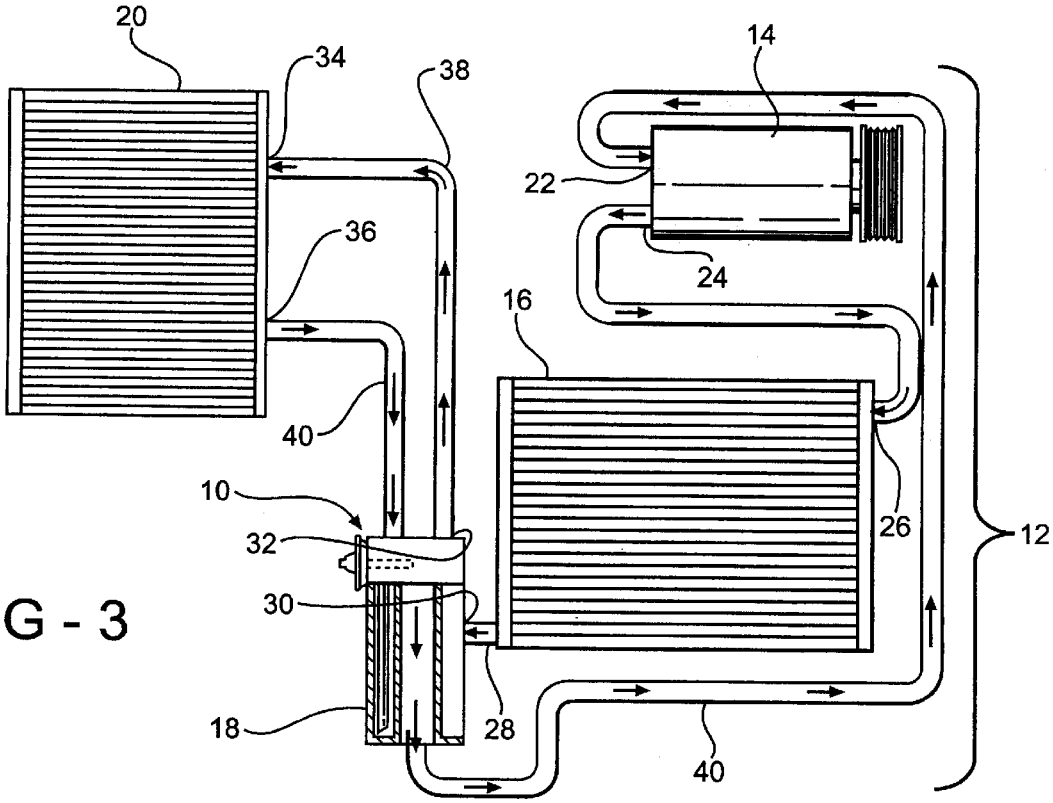
FIG - 3
FIG - 4B
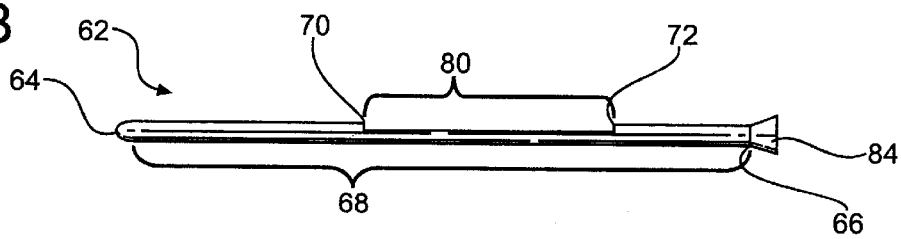
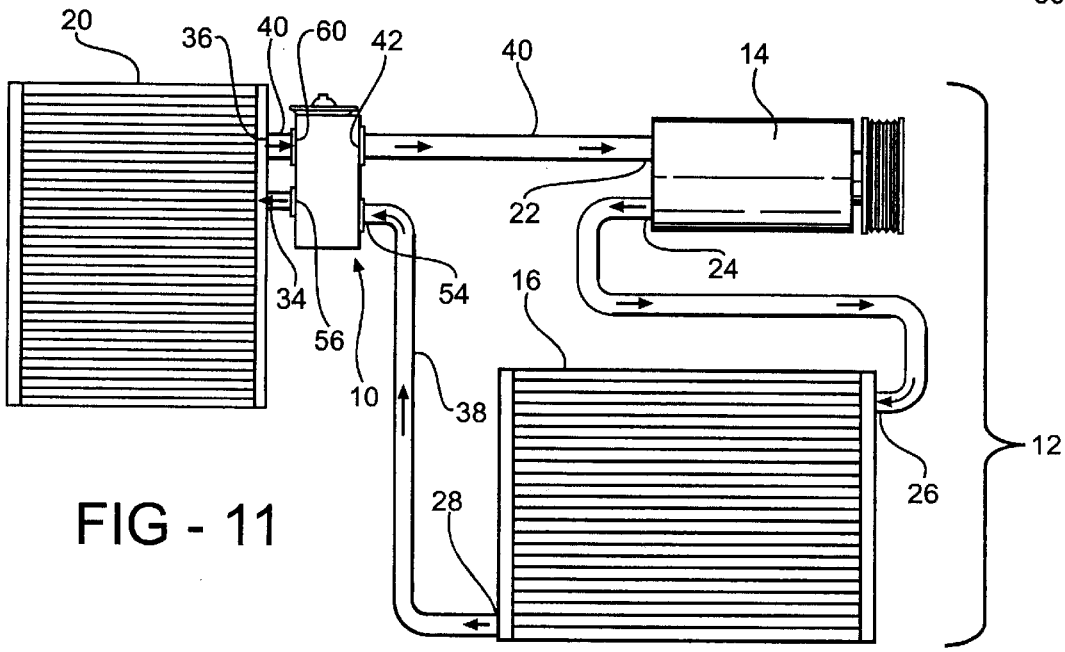
FIG - 11

THERMOSTATIC EXPANSION VALVE AND AIR CONDITIONING SYSTEM FOR LOW REFRIGERANT CHARGE

RELATED APPLICATIONS

The subject application is related to commonly-assigned United States patent applications entitled "Air Conditioning System and Tubing Apparatus to Prevent Heat Gain due to Engine Compartment Heat" and "Multi-Function Receiver" which were both filed on the same day as the subject application.

TECHNICAL FIELD

The subject invention generally relates to a thermostatic expansion valve (TXV) for use in an air conditioning system of a motor vehicle. More specifically, the subject invention relates to a TXV that controls the flow of refrigerant to an evaporator and a compressor of the air conditioning system under conditions of normal and low refrigerant charge.

BACKGROUND OF THE INVENTION

A thermostatic expansion valve (TXV) is known in the art. In fact, the TXV has been utilized to regulate, i.e., control, a flow of refrigerant in air conditioning systems for many years. As understood by those skilled in the art, in addition to the TXV, the air conditioning systems also include a refrigerant compressor, a condenser, a receiver, and an evaporator.

The refrigerant is in a vapor or gaseous phase as it exits the evaporator. To appropriately control the flow of refrigerant in the air conditioning system, the TXV senses a superheat of the refrigerant as the flow leaves the evaporator. If the superheat of the refrigerant is too high, then the TXV opens to increase the flow of refrigerant into the evaporator which, in turn, reduces the superheat. On the other hand, if the superheat of the refrigerant is too low, then the TXV closes to decrease the flow of refrigerant into the evaporator which, in turn, increases the superheat.

It is understood in the art that, when the air conditioning system has low refrigerant charge and the superheat of the refrigerant is too high, a problem occurs. The problem is that there is not enough refrigerant throughout the air conditioning system to flow into the evaporator to reduce the superheat of the refrigerant. The TXVs of the prior art are unable to remedy this problem. That is, the TXVs of the prior art are unable to appropriately control the flow of refrigerant throughout the air conditioning system when the air conditioning system has low refrigerant charge.

Although the conventional TXVs are fully-open when the superheat of the refrigerant is too high, the superheat of the refrigerant remains too high since there is not enough refrigerant throughout the air conditioning system to flow into and through the evaporator and reduce the superheat. Since the flow of refrigerant through the evaporator is reduced, the evaporator essentially 'traps' the refrigerant that is necessary to flow to the compressor to appropriately lube the compressor. That is, as the flow of refrigerant through the evaporator is reduced, the evaporator tends to trap oil that is necessary for lubrication of the compressor. Without appropriate lubrication, the operating life, i.e., the durability, of the compressor is jeopardized. The excessive superheat of the smaller amounts of refrigerant that do flow through the evaporator and to the compressor also jeopardize the operating life of the compressor as the refrigerant, in this condition, cannot remove heat from the compressor, as is desired. This result is undesirable and increases wear of the compressor.

Due to the inadequacies of the prior art, including those described above, it is desirable to provide a TXV that is able to control the flow of refrigerant to the evaporator and to the compressor under both normal and low refrigerant charge such that the operating life of the compressor is not jeopardized.

SUMMARY OF THE INVENTION

A thermostatic expansion valve (TXV) for use in an air conditioning system is disclosed. The air conditioning system includes a refrigerant compressor, a condenser in fluid communication with an outlet of the compressor, a receiver in fluid communication with an outlet of the condenser, and an evaporator in fluid communication with an outlet of the receiver and with an inlet of the compressor. The TXV of the subject invention controls a flow of the refrigerant to the evaporator under conditions of normal refrigerant charge and controls the flow of the refrigerant to both the evaporator and the compressor under conditions of low refrigerant charge.

The TXV includes a valve body having first and second ends and an interior wall defining a fluid chamber between the first and second ends. The TXV also includes a liquid refrigerant inlet and first and second liquid refrigerant outlets.

The liquid refrigerant inlet is defined within the valve body and is in fluid communication with the fluid chamber such that the refrigerant can flow from the receiver through the liquid refrigerant inlet and into the fluid chamber. The first liquid refrigerant outlet is defined within the valve body and is in fluid communication with the fluid chamber such that the refrigerant can flow from the fluid chamber through the first liquid refrigerant outlet and to the evaporator during the conditions of normal and low refrigerant charge. The second liquid refrigerant outlet is defined within the valve body and is in fluid communication with the fluid chamber such that the refrigerant can flow from the fluid chamber through the second liquid refrigerant outlet and to the refrigerant compressor during the conditions of low refrigerant charge.

A needle is disposed in the fluid chamber. The needle is moveable within the fluid chamber to control the flow of the refrigerant into and out of the valve body during the conditions of normal and low refrigerant charge. Furthermore, a notch is defined within the needle. The notch extends between the liquid refrigerant inlet and the second liquid refrigerant outlet. As such, during the conditions of low refrigerant charge, an amount of the refrigerant that flows into the fluid chamber from the receiver can flow through the fluid chamber to the second liquid refrigerant outlet and to the refrigerant compressor without flowing through the evaporator. The notch essentially established a bypass for the refrigerant to bypass the evaporator and flow directly to the compressor. The amount of the refrigerant that flows directly to the compressor 'assists' or 'protects' the compressor by guaranteeing that the compressor is appropriately tubed by the refrigerant. Furthermore, adequate amounts of the refrigerant flow to the compressor such that any heat present in the compressor is removed and the compressor can be cooled. Overall, the operating life of the compressor is improved as a result of the TXV of the subject invention.

Accordingly, the subject invention provides a TXV that assists the compressor by controlling the flow of refrigerant to the compressor under conditions of low refrigerant charge thereby maintaining an acceptable operating life for the compressor.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a schematic view of the air conditioning system illustrating a block-type TXV mounted to the receiver;

FIG. 4B is a side view of a needle of the cartridge-type thermostatic expansion valve of FIG. 4A;

FIG. 11 is a schematic view of an alternative air conditioning system having a refrigerant compressor, a condenser, an evaporator, and a thermostatic expansion valve (TXV) according to the subject invention mounted adjacent the evaporator.

DESCRIPTION OF THE PREFERRED EMBODIMENT

Figure 1:
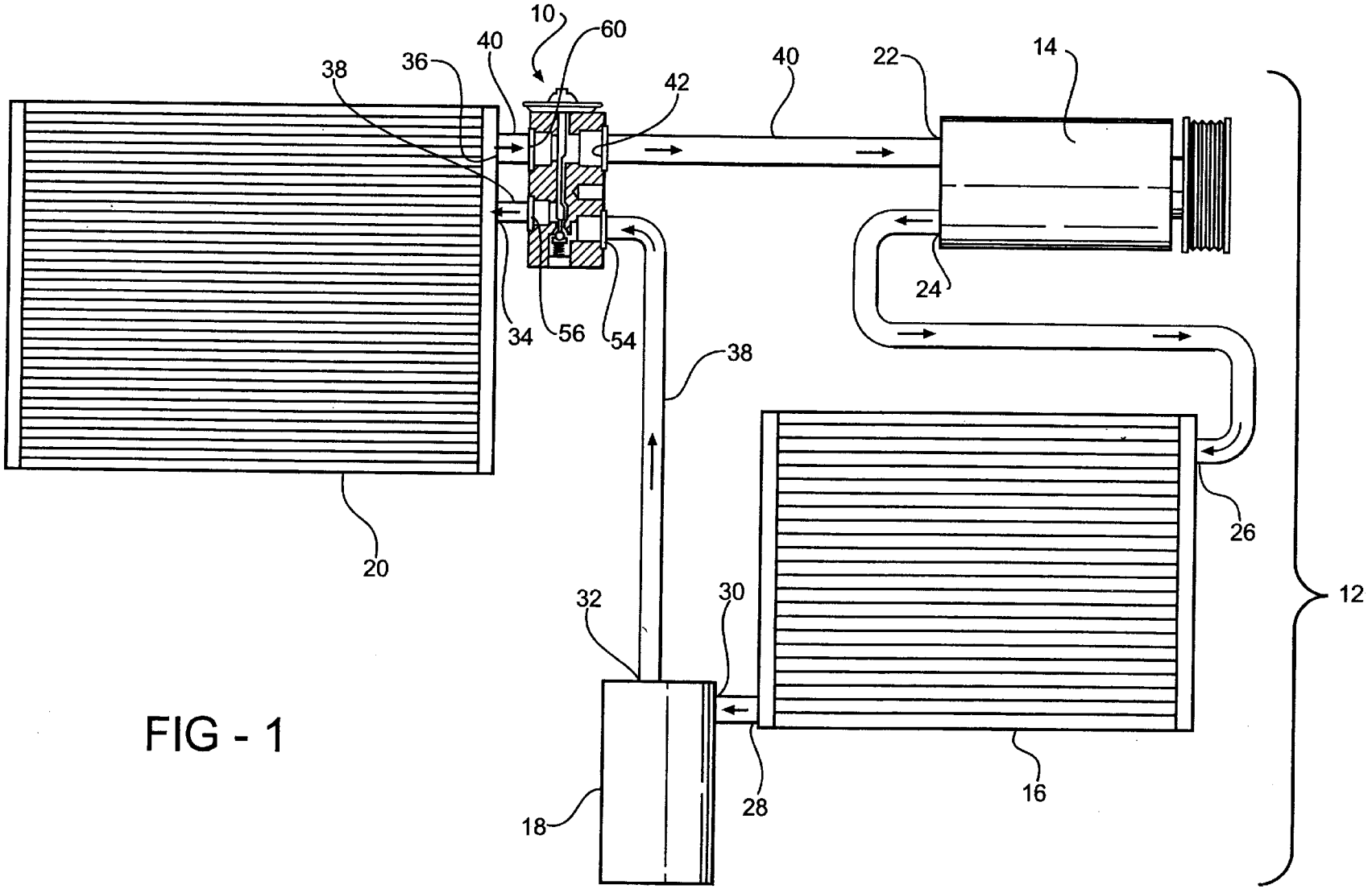
FIG. 1 is a schematic view of an air conditioning system having a refrigerant compressor, a condenser, a receiver, an evaporator, and a thermostatic expansion valve (TXV) according to the subject invention mounted adjacent the evaporator.

Referring to the Figures, wherein like numerals indicate like or corresponding parts throughout the several views, a thermostatic expansion valve (TXV) is generally disclosed at 10. As disclosed particularly in FIGS. 1–3, the TXV 10 is used in an air conditioning system, which is generally indicated at 12.

In addition to the TXV 10, the air conditioning system 12 includes a refrigerant compressor 14, a condenser 16, a receiver 18, and an evaporator 20. The compressor 14 has a compressor inlet 22 and a compressor outlet 24, the condenser 16 has a condenser inlet 26 and a condenser outlet 28, the receiver 18 has a receiver inlet 30 and a receiver outlet 32, and the evaporator 20 has an evaporator inlet 34 and an evaporator outlet 36. FIG. 3 discloses an alternative embodiment for the air conditioning system 12 where the TXV 10 is mounted to the receiver 18. The alternative embodiment for FIG. 3 will be described below.

Figure 2:
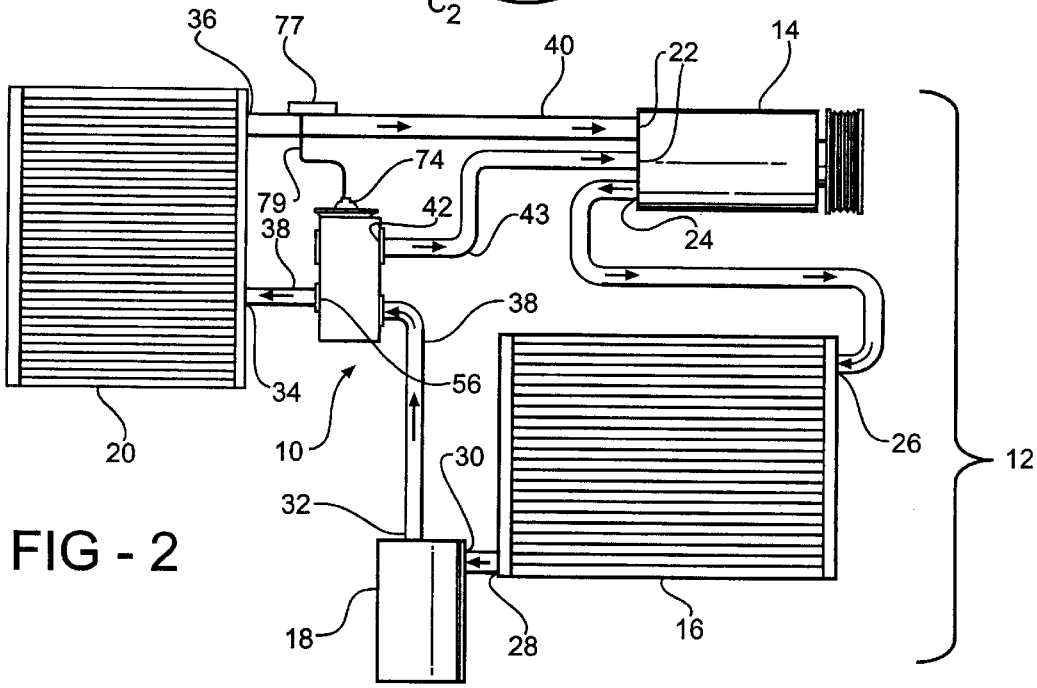
FIG. 2 is a schematic view of the air conditioning system illustrating alternative refrigerant tubing extending from the evaporator to the compressor without the refrigerant flowing from the evaporator through the TXV.

Referring to FIGS. 1 and 2, the condenser 16 is in fluid communication with the compressor outlet 24. More specifically, the condenser inlet 26 is in fluid communication with the compressor outlet 24. The compressor 14 pumps the refrigerant to the condenser 16 where a phase of the refrigerant changes from a vapor to a liquid due to the removal of heat by the condenser 16. The refrigerant then flows into the receiver 18 where it is stored for flow into the evaporator 20. More specifically, the receiver inlet 30 is in fluid communication with the condenser-outlet 28 to receive the refrigerant. The evaporator 20 is in fluid communication with the receiver outlet 32, through the TXV 10, and in fluid communication with the compressor inlet 22, through the TXV 10. In other words, in one sense the TXV 10 is disposed in the flow between the receiver 18 and the evaporator 20, and in another sense the TXV 10 is disposed in the flow between the evaporator 20 and the compressor 14. The refrigerant flows from the receiver 18, through the TXV 10, and into the evaporator 18 where it functions to cool air that is to be directed into a passenger compartment of a vehicle. In the evaporator 18, the phase of the refrigerant changes to a vapor and the refrigerant returns to the compressor inlet 22 through the TXV 10. Although the evaporator 20 is not in direct fluid communication with the condenser 16 and with the compressor 14, it is to be understood that the evaporator 20 is in fluid communication with the condenser 16, indirectly, through the TXV 10 and the receiver 18, and is in fluid communication with the compressor 14, indirectly, through the TXV 10. Therefore, for the purposes of the subject invention, use of the terminology "in fluid communication with" is not intended to require direct connection between any two components of the air conditioning system 12.

As understood by those skilled in the art, various refrigerant tubes, disclosed but not numbered throughout the Figures, are connected to and between the various components of the air conditioning system 12 to accommodate the flow of refrigerant between the components. For instance, a first refrigerant tube 38, commonly referred to in the art as "the low pressure liquid refrigerant tube" is connected between the receiver 18 and the evaporator 20 to accommodate the flow of refrigerant from the receiver 18 to the evaporator 20. As disclosed in FIG. 1, the TXV 10 is disposed in the first refrigerant tube 18. Also for instance, a second refrigerant tube 40, commonly referred to in the art as "a suction gas tube" 40 is connected between the evaporator 20 and the compressor 14 to accommodate the flow of refrigerant from the evaporator 20 to the compressor 14. More specifically, at least part of the suction gas tube 40 is connected between a second liquid refrigerant outlet 42 of the TXV 10, which is described below, and the compressor 14 for accommodating the flow of the refrigerant from a fluid chamber 44 of the TXV 10, also described below, to the compressor 14. As disclosed in FIG. 1, the TXV 10 is disposed in the second refrigerant tube 40.

The TXV 10 of the present invention, and therefore the air conditioning system 12 of the present invention, which includes the TXV 10, controls, i.e., regulates, the flow of refrigerant to the evaporator 20 under conditions of normal refrigerant charge and controls, i.e., regulates, the flow of refrigerant to the evaporator 20 and to the compressor 14 under conditions of low refrigerant charge. As a result, even under conditions of low refrigerant charge, the TXV 10 of the subject invention maintains the operating life of the compressor 14 by ensuring that the compressor 14 receives some amount of refrigerant. As understood by those skilled in the art, the air conditioning system 12 may be under the conditions of low charge for a variety reasons including, but not limited to, a leak in the air conditioning system 12.

Figure 9:
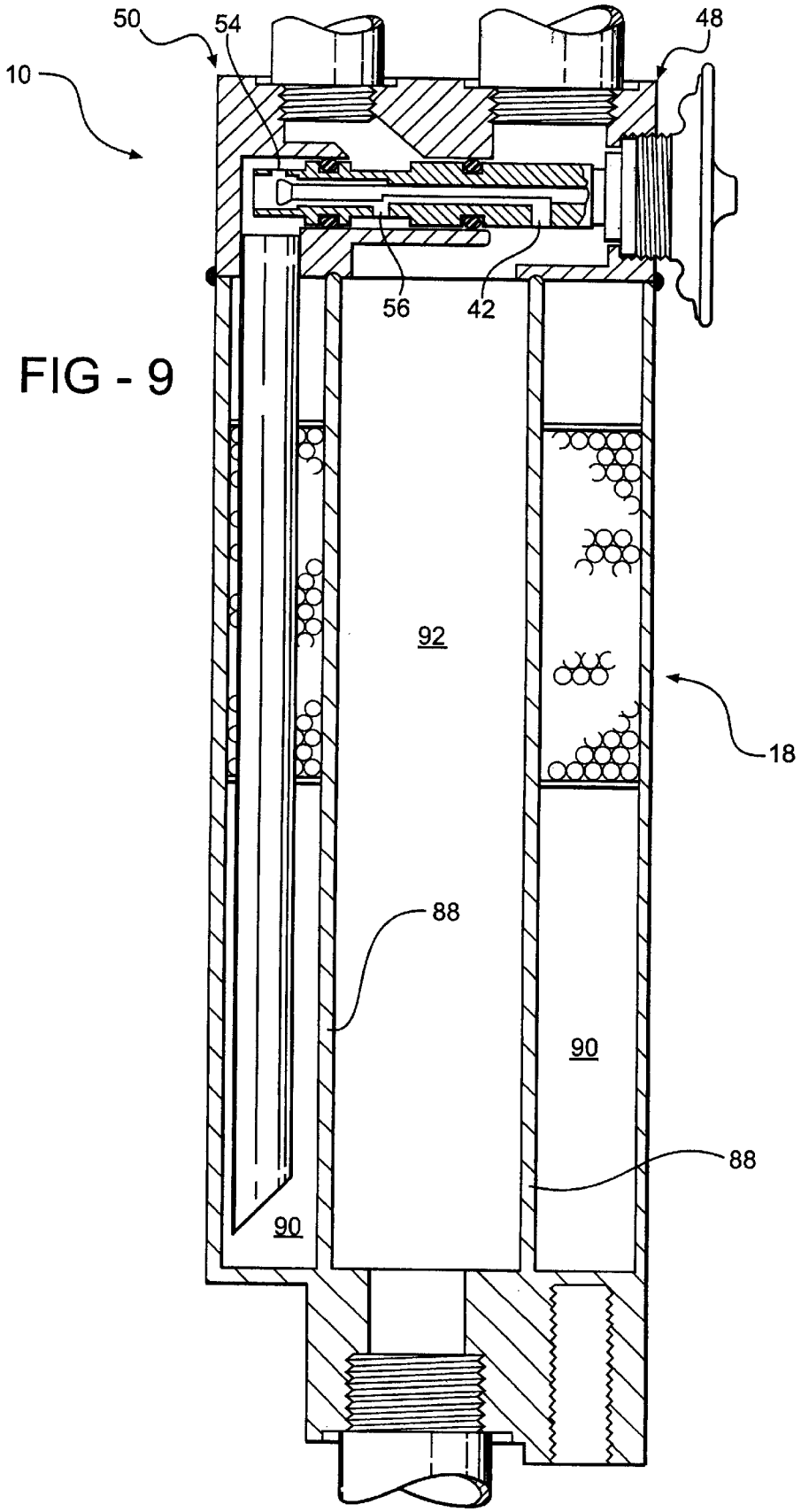
FIG. 9 is a partially cross-sectional view of the cartridge-type thermostatic expansion valve of FIG. 4 mounted in a multi-function receiver in the fully-open position.
Figure 10:
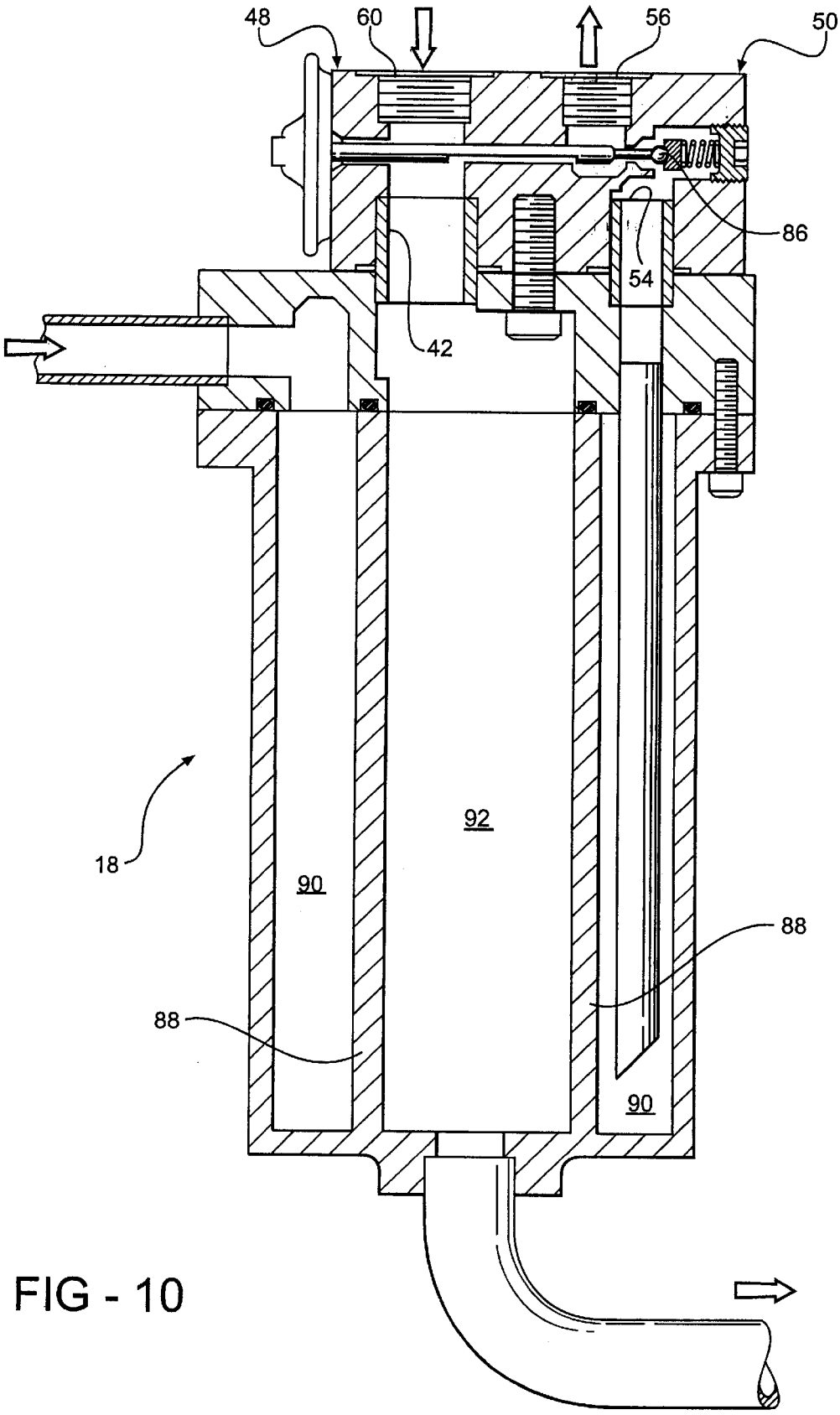
FIG. 10 is a partially cross-sectional view of the block-type thermostatic expansion valve of FIG. 5 mounted to the multi-function receiver in the fully-open position.

As disclosed in FIGS. 3, 9, and 10, the TXV 10 of the subject invention may be removed from its position in FIG. 1 and, instead, mounted to or disposed in the receiver 18. As understood by those skilled in the art, if the TXV 10 is a block-type TXV 10, then it is essentially mounted to the receiver 18. Alternatively, if the TXV 10 is a cartridge-type TXV 10, then it is essentially disposed in the receiver 18. The receiver 18 is generically disclosed in FIGS. 1–3. However, if the TXV 10 is mounted to the receiver 18 (see FIGS. 3 and 10) or inserted into the receiver 18 (see FIG. 9), then the receiver 18 is preferably a multi-function receiver 18. The multi-function receiver 18 is described below and also in commonly-assigned United States patent applications entitled "Air Conditioning System and Tubing Apparatus to Prevent Heat Gain due to Engine Compartment Heat" and "Multi-Function Receiver" which were both filed on the same day as the subject application, the disclosures of which are both herein incorporated by reference in their entirety.

The TXV 10 comprises a valve body 46. In FIGS. 4, 6–7, and 9, where the TXV 10 is the cartridge-type TXV 10, the valve body 46 is relatively narrow. On the other hand, in FIGS. 5 and 10, where the TXV 10 is the block-type TXV 10, the valve body 46 is more block-type and bulky relative to the valve body 46 in the cartridge-type TXV 10 embodiments.

The valve body 46 comprises a first end 48, a second end 50, and an interior wall 52 defining the fluid chamber 44 between the first and second ends 48, 50. It is preferred that the fluid chamber 44 is generally cylindrical. However, the fluid chamber 44 may be squared.

In FIGS. 1–7, the TXV 10 is vertically-oriented such that the first end 48 is a top end of the TXV 10 and the second end 50 is a bottom end of the TXV 10. However, as disclosed in both FIGS. 9 and 10, the TXV 10 may be horizontally-oriented such that the first end 48 is a right or left end of the TXV 10 and the second end 50 is the opposite end of the TXV 10. For example, as disclosed in FIG. 9, the first end 48 is a right end of the TXV 10, and as disclosed in FIG. 10, the first end 48 is a left end of the TXV 10. As for the flow of refrigerant from the receiver 18 to the evaporator 20, the valve body 46 is disposed between the receiver 18 and the evaporator 20. As for the flow of refrigerant between the evaporator 20 and the compressor 14, the valve body 46 is disposed between the evaporator 20 and the compressor 14.

Figure 5:
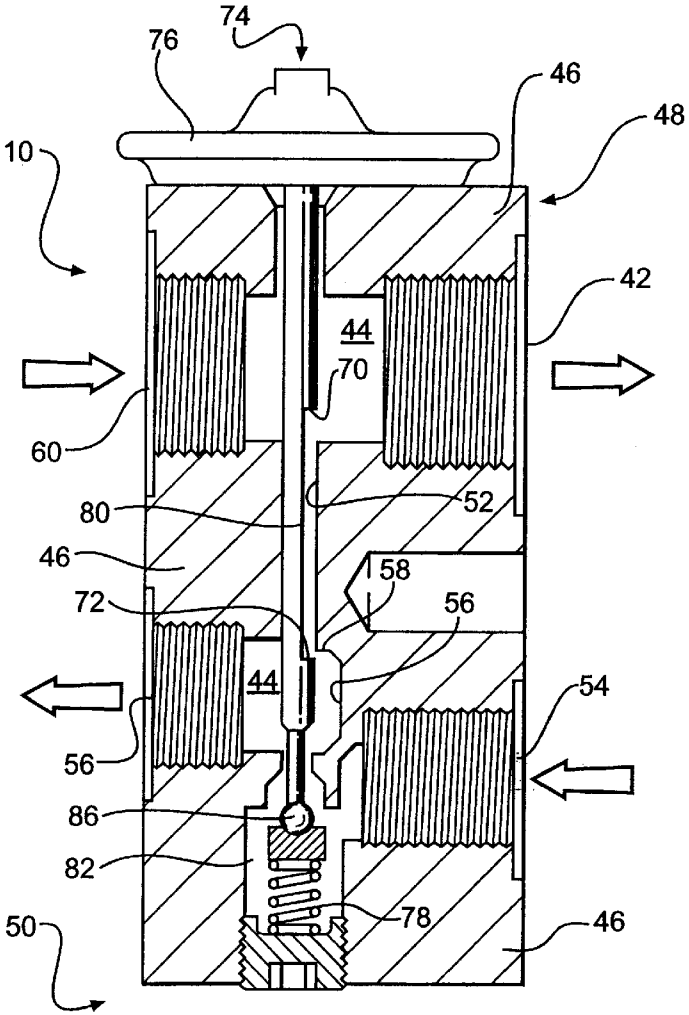
FIG. 5 is a partially cross-sectional view of a block-type thermostatic expansion valve according to the subject invention in the fully-open position.
Figure 4A:
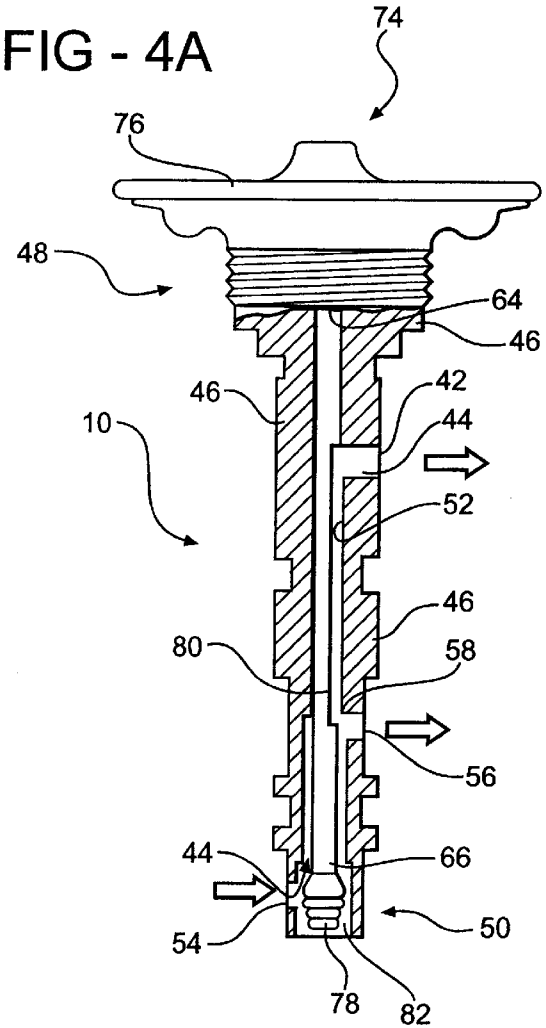
FIG. 4A is a partially cross-sectional view of a cartridge-type thermostatic expansion valve according to the subject invention in a fully-open position.

Referring particularly to FIGS. 4 and 5, a liquid refrigerant inlet 54, or port, is defined within the valve body 46. The liquid refrigerant inlet 54 is in fluid communication with the receiver 18 and the fluid chamber 44. As such, the refrigerant can flow from the receiver 18 through the liquid refrigerant inlet 54 and into the fluid chamber 44.

A first liquid refrigerant outlet 56 and the second liquid refrigerant outlet 42 are also defined within the valve body 46. The first and second liquid refrigerant outlets 56, 42 may also be referred to as ports. The first liquid refrigerant outlet 56 is in fluid communication with the fluid chamber 44 and the evaporator 20. As such, the refrigerant can flow from the fluid chamber 44 through the first liquid refrigerant outlet 56 and to the evaporator 20 during the conditions of normal and low refrigerant charge. The first liquid refrigerant outlet 56 and the interior wall 52 define an isolation shelf 58. The import of the isolation shelf 58 is described below.

The second liquid refrigerant outlet 42 is in fluid communication with the fluid chamber 44 and the compressor 14. The suction gas tube 40 is connected to the second liquid refrigerant outlet 42 of the TXV 10. As such, the refrigerant can flow from the fluid chamber 44 through the second liquid refrigerant outlet 42 and to the compressor 14 during the conditions of low refrigerant charge. It is to be understood that the second liquid refrigerant outlet 42 is described as such only for descriptive purposes even though gaseous, i.e., non-liquid, refrigerant from the evaporator 20 may also flow through the second liquid refrigerant outlet 42.

As disclosed in FIGS. 1–5, and 10–11, a gaseous refrigerant inlet 60, or port, is preferably included. That is, although not required, the gaseous refrigerant inlet 60 may also be defined within the valve body 46. If included, the gaseous refrigerant inlet 60 is in fluid communication with the fluid chamber 44 such that the refrigerant can flow from the evaporator 20, where it is gaseous, through the gaseous refrigerant inlet 60 and into the fluid chamber 44. As such, the flow of refrigerant from the evaporator 20 is essentially routed back through the TXV 10 where it then flows through the fluid chamber 44, through the second liquid refrigerant outlet 42 and to the compressor 14. On the other hand, it is to be understood that there is no requirement for a second refrigerant inlet, i.e., the gaseous refrigerant inlet 60. Instead, as disclosed in FIG. 2, the evaporator 20 can outlet directly to the compressor 14 without the refrigerant from the evaporator 20 flowing through the TXV 10. In the embodiment of FIG. 2, compressor 14 includes two separate compressor inlets 22, and the second liquid refrigerant outlet 42 is connected to the compressor 14 via an alternative tube 43.

The TXV 10 further includes a needle 62, or operating pin or stem, that is disposed in the fluid chamber 44. Referring particularly to FIG. 4B, the needle 62 includes an actuation end 64, a control end 66, and a shank portion 68. The shank portion 68 of the needle 62 extends between the actuation end 64 and the control end 66. The needle 62 also comprises first and second ledges 70, 72, respectively. The first and second ledges 70, 72 are disposed in the shank portion 68 of the needle 62 and are described additionally below.

The needle 62 is moveable within the fluid chamber 44, to control the flow of the refrigerant into and out of the valve body 46 during the conditions of normal and low refrigerant charge. More specifically, under conditions of normal refrigerant charge, the needle 62 controls the flow of the refrigerant into the valve body 46 through the liquid refrigerant inlet 54 and out of the valve body 46 through the first liquid refrigerant outlet 56 to the evaporator 20. Under conditions of low refrigerant charge, the needle 62 controls the flow of the refrigerant into the valve body 46 through the liquid refrigerant inlet 54 and out of the valve body 46 through the first liquid refrigerant outlet 56 to the evaporator 20 and through the second liquid refrigerant outlet 42 to the compressor 14.

An actuation mechanism 74, preferably a diaphragm 76, is disposed adjacent the first end 48 of the valve body 46 to move the needle 62. The actuation mechanism 74 engages the needle 62 to move the needle 62 within the fluid chamber 44 to control the flow of the refrigerant into and out of the TXV 10, i.e., into and out of the valve body 46 of the TXV 10. More specifically, the actuation mechanism 74 engages the actuation end 64 of the needle 62 to move the needle 62 within the fluid chamber 44.

As shown in FIGS. 1, 3, 5, and 9–11, the refrigerant from the evaporator 20 is returned back through the TXV 10. As such, the TXV 10 can sense or monitor the superheat directly and an external superheat sensing bulb is not required to sense the superheat elsewhere. However, the particular embodiment of the subject invention disclosed in FIGS. 2, 4A, and 6–7 does not return the refrigerant from the evaporator 20 back through the TXV 10. As such, the actuation mechanism 74, preferably the diaphragm 76, is in communication with a power element, i.e., an external superheat sensing bulb 77 and a superheat sensing tube 79, which senses the superheat of the refrigerant to control the TXV 10 through movement of the needle 62 within the fluid chamber 44.

The movement of the needle 62 into various positions is described below. The subject invention preferably incorporates a biasing device 78 to bias the needle 62 back toward the actuation mechanism 74. The biasing device 78 is disposed between the second end 50 of the valve body 46 and the control end 66 of the needle 62. Suitable biasing devices 78 include, but are not limited to, compression springs.

A notch 80 is defined within the needle 62. It is to be understood that the notch 80 may also be referred to as a flat, channel, slot, recess, or the like. The notch 80 extends between the liquid refrigerant inlet 54 and the second liquid refrigerant outlet 42 such that, during the conditions of low refrigerant charge, an amount of the refrigerant that flows into the fluid chamber 44 from the receiver 18 can flow through the fluid chamber 44 to the second liquid refrigerant outlet 42 and to the compressor 14 without flowing through the evaporator 20. More specifically, the notch 80 is defined between the first and second ledges 70, 72 of the needle 62.

The notch 80 essentially established a bypass for the refrigerant to bypass the evaporator 20 and flow directly to the compressor 14. The amount of the refrigerant that flows directly to the compressor 14 'assists' or 'protects' the compressor 14 by guaranteeing that the compressor 14 is appropriately lubed by the refrigerant even under conditions of low refrigerant charge. Furthermore, adequate amounts of the refrigerant flow to the compressor 14 such that any heat present in the compressor 14 is removed and the compressor 14 can be cooled as desired. Therefore, the notch 80 of the TXV 10 functions to assist the compressor 14 by controlling the flow of refrigerant to the compressor 14 under the conditions of low refrigerant charge. The notch 80 of the TXV 10 maintains an acceptable operating life for the compressor 14.

Figure 7:
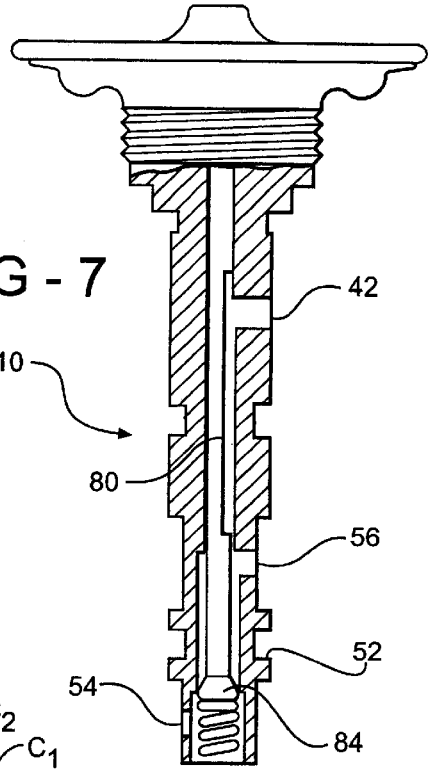
FIG. 7 is a partially cross-sectional view of the cartridge-type expansion valve of FIG. 4 in a closed position.

As disclosed in FIG. 7, the needle 62 is moveable within the fluid chamber 44 into a closed-position. In the closed-position, the first and second liquid refrigerant outlets 56, 42 are isolated from the liquid refrigerant inlet 54. As a result, the refrigerant is prevented from flowing from the liquid refrigerant inlet 54 through the fluid chamber 44 and the first liquid refrigerant outlet 56 to the evaporator 20, and from flowing from the liquid refrigerant inlet 54 through the fluid chamber 44 and the second liquid refrigerant outlet 42 to the compressor 14.

Figure 6:
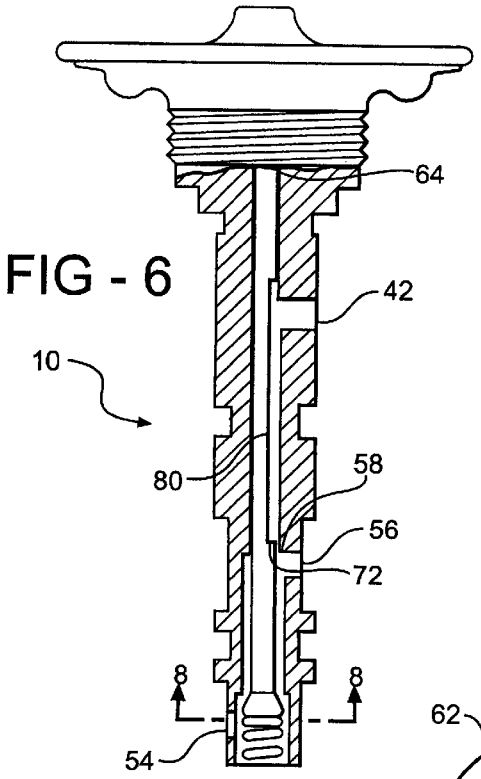
FIG. 6 is a partially cross-sectional view of the cartridge-type expansion valve of FIG. 4 in a partially-open position.

As disclosed in FIG. 6, the needle 62 is moveable within the fluid chamber 44 into a partially-open position. Preferably, the needle 62 is moved into the partially-open position during conditions of normal refrigerant charge such that the first liquid refrigerant outlet 56 is in fluid communication with the liquid refrigerant inlet 54, and such that the second liquid refrigerant outlet 42 is isolated from the liquid refrigerant inlet 54. The second liquid refrigerant outlet 42 is isolated from the liquid refrigerant inlet 54 because the second ledge 72 of the needle 62 abuts the isolation shelf 58 when the needle 62 is moved into the partially-open position. As such, the refrigerant cannot flow through the notch 80 of the needle 62 and to the second liquid refrigerant outlet 42. The abutment of the second ledge to the isolation shelf 58 effectively isolates the second liquid refrigerant outlet 42 from the liquid refrigerant inlet 54. As a result, the refrigerant can flow from the liquid refrigerant inlet 54 through the fluid chamber 44 and the first liquid refrigerant outlet 56 to the evaporator 20, but the refrigerant cannot flow from the liquid refrigerant inlet 54 through the fluid chamber 44 and the second liquid refrigerant outlet 42 to the compressor 14. That is, in the partially-open position, the refrigerant can flow to the evaporator 20 but cannot flow to the compressor 14.

As disclosed in FIG. 4, the needle 62 is moveable within the fluid chamber 44 into a fully-open position. Preferably, the needle 62 is moved into the fully-open position during conditions of low refrigerant charge such that the first and second liquid refrigerant outlets 56, 42 are in fluid communication with the liquid refrigerant inlet 54. As a result, the refrigerant can flow from the liquid refrigerant inlet 54 through the fluid chamber 44 and the first liquid refrigerant outlet 56 to the evaporator 20, and from the liquid refrigerant inlet 54 through the fluid chamber 44 and the second liquid refrigerant outlet 42 to the compressor 14. That is, in the fully-open position, the refrigerant can flow through the fluid chamber 44 to both the evaporator 20 and the compressor 14. The amount of refrigerant that flows to the compressor 14, flows to the compressor 14 without first flowing through the evaporator 20.

Referring primarily to FIGS. 4–7, the fluid chamber 44 terminates at a liquid refrigerant reservoir 82. The liquid refrigerant reservoir 82 is in fluid communication with the liquid refrigerant inlet 54. As such, the liquid refrigerant reservoir 82 receives the refrigerant from the receiver 18. The control end 66 of the needle 62 is disposed in the liquid refrigerant reservoir 82.

Figure 8:
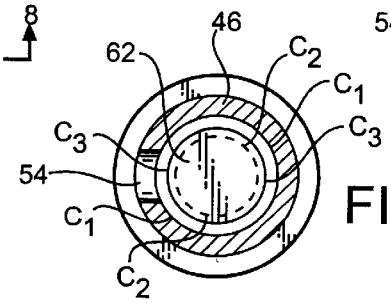
FIG. 8 is a partially cross-sectional view taken along line 8—8 in FIG. 6 illustrating the relative circumferences of a liquid refrigerant reservoir, a sealing device, and a fluid chamber of the cartridge-type thermostatic expansion valve.

As disclosed in FIG. 8, the liquid refrigerant reservoir 82 has a circumference $C_1$. The circumference $C_1$ of the liquid refrigerant reservoir 82 is greater than a circumference $C_2$ of the fluid chamber 44. The interior wall 52 of the valve body 46 defines the circumference $C_2$ of the fluid chamber 44. Because the circumference $C_2$ of the fluid chamber 44 is less than the circumference $C_1$ of the liquid refrigerant reservoir 82, the needle 62 is able to, in certain positions, abut the interior wall 52, i.e., the circumference $C_2$ of the fluid chamber 44, to control the flow of the refrigerant.

More specifically, a sealing device 84 is disposed at the control end 66 of the needle 62. The sealing device 84 is the portion of the needle 62 that controls the flow of the refrigerant into and out of the TXV 10. As disclosed throughout the Figures, a circumference $C_3$ of the sealing device 84 is less than the circumference $C_1$ of the liquid refrigerant reservoir 82 such that the sealing device 84 is moveable within the reservoir 82. On the other hand, the circumference $C_3$ of the sealing device 84 is greater than the circumference $C_2$ of the fluid chamber 44. Therefore, as disclosed in FIG. 7, when the needle 62 is moved into the closed position, the sealing device 84 abuts the interior wall 52 to isolate the first and second liquid refrigerant outlets 56, 42 from the liquid refrigerant inlet 54 and from the liquid refrigerant reservoir 82.

As disclosed in the Figures, it is preferred that the sealing device 84 integrally extends from the needle 62, i.e., the sealing device 84 is one with the needle 62. However, the sealing device 84 may, in alternative embodiments, be separately welded, or otherwise connected, to the control end 66 of the needle 62. Referring to FIGS. 4, 6–7, and 9, the sealing device 84 is conical and therefore extends at an angle from the control end 66 of the needle 62. As such, the sealing device 84 is able to gradually control the flow of refrigerant from the liquid refrigerant reservoir 82 into the fluid chamber 44 as the needle 62 is moved within the fluid chamber 44. If the sealing device 84 is angled, then the further the needle 62 is moved by the actuation-mechanism 74 away from the first end 48 of the valve body 46 and toward the second end 50, the more refrigerant can flow into the fluid chamber 44 and to the first and second liquid refrigerant outlets 56, 42, and vice versa. Referring to FIGS. 5 and 10, the sealing device 84 is further defined as a sphere 86. As disclosed in these Figures, the sphere 86 is contoured to gradually control the flow of refrigerant from the liquid refrigerant reservoir 82 into the fluid chamber 44 as the needle 62 is moved within the fluid chamber 44.

Although the receiver 18 is included in the most preferred air conditioning system 12, the receiver 18 is not required in the subject invention. That is, as disclosed in FIG. 11, the refrigerant can flow directly from the condenser 16 to the TXV 10 without first flowing through a receiver 18. If, as in this alternative embodiment, the receiver 18 is not present, then the air conditioning system 12 includes the compressor 14, the condenser 16, the TXV 10, and the evaporator 20. The scope of the subject invention is not impacted whether the receiver 18 is present in the air conditioning system 12 or not.

In this alternative embodiment, where the receiver 18 is not present, the valve body 46, in one sense, is disposed between the condenser 16 and the evaporator 20, and in another sense, the valve body 46 is disposed between the evaporator 20 and the compressor 14. Furthermore, the liquid refrigerant inlet 54 is fluid communication with the condenser 16 and the fluid chamber 44 such that the refrigerant can flow from the condenser 16 through the liquid refrigerant inlet 54 and into the fluid chamber 44. More specifically, the outlet 28 of the condenser 16 is in direct fluid communication with the liquid refrigerant inlet 54 of the TXV 10.

In this alternative embodiment, the first and second liquid refrigerant outlets 56, 42 are as described above in the preferred embodiment. In this embodiment, the notch 80 permits the amount of the refrigerant that flows into the fluid chamber 44 from the condenser 16 to flow through the fluid chamber 44 to the second liquid refrigerant outlet 42 and to the compressor 14 without flowing through the evaporator 20.

On the other hand, in all of the embodiments where the receiver 18 is included in the air conditioning system 12, then it is preferred that the receiver 18 is the multi-function receiver 18. As described more in the related applications, the multi-function receiver 18 enables the vaporized refrigerant from the evaporator 20 to be re-routed back through the multi-function receiver 18 prior to flowing to the compressor 14. As such, the multi-function receiver 18 attenuates any pressure fluctuations of the refrigerant flowing from the evaporator 20 to the compressor 14. As a result, any noise, e.g. tone, that is associated with the pressure fluctuations of the refrigerant is minimized, if not entirely eliminated. The pressure fluctuations of the refrigerant are also referred to in the art as pulsations.

Referring now to FIGS. 9 and 10, the multi-function receiver 18 is described in greater detail. The multi-function receiver 18 comprises an internal wall 88. The internal wall 88 of the multi-function receiver 18 defines an outer cavity 90 and an inner cavity 92. The outer cavity 90 is in fluid communication with the outlet 28 of the condenser 16 for receiving the refrigerant from the condenser 16, and the inner cavity 92 is in fluid communication with the compressor 14, specifically the inlet 22 of the compressor 14, for sending the refrigerant to the compressor 14.

More specifically, the liquid refrigerant inlet 54 of the TXV 10 is in fluid communication with the outer cavity 90 of the multi-function receiver 18. As such, the TXV 10 is able to receive refrigerant from the outer cavity 90 into the fluid chamber 44. The second refrigerant outlet 42 of the TXV 10 is in fluid communication with the inner cavity 92 of the receiver 18 to receive the refrigerant from the fluid chamber 44 into the inner cavity 92. As such, during the conditions of low refrigerant charge, the amount of the refrigerant that flows into the fluid chamber 44 from the outer cavity 90 can flow through the fluid chamber 44 to the second liquid refrigerant outlet 42, to the inner cavity 92, and to the compressor 14 without flowing through the evaporator 20.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A thermostatic expansion valve for use in an air conditioning system that includes a refrigerant compressor, a condenser in fluid communication with an outlet of the compressor, a receiver in fluid communication with an outlet of the condenser, and an evaporator in fluid communication with an outlet of the receiver and with an inlet of the compressor, wherein said thermostatic expansion valve is adapted to control a flow of refrigerant to the evaporator under conditions of normal refrigerant charge, and is adapted to control the flow of refrigerant to the evaporator and to the compressor under conditions of low refrigerant charge, said thermostatic expansion valve comprising:

a valve body comprising a first end, a second end, and an interior wall defining a fluid chamber between said ends;

a liquid refrigerant inlet defined within said valve body in fluid communication with said fluid chamber such that the refrigerant can flow from the receiver through said liquid refrigerant inlet and into said fluid chamber;

a first liquid refrigerant outlet defined within said valve body in fluid communication with said fluid chamber such that the refrigerant can flow from said fluid chamber through said first liquid refrigerant outlet and to the evaporator during the conditions of normal and low refrigerant charge;

a second liquid refrigerant outlet defined within said valve body in fluid communication with said fluid chamber such that the refrigerant can flow from said fluid chamber through said second liquid refrigerant outlet and to the compressor during the conditions of low refrigerant charge;

a needle disposed in said fluid chamber and being moveable therein to control the flow of the refrigerant into and out of said valve body during the conditions of normal and low refrigerant charge; and a notch defined within said needle extending between said liquid refrigerant inlet and said second liquid refrigerant outlet such that, during the conditions of low refrigerant charge, an amount of the refrigerant that flows into said fluid chamber, from the receiver can flow through said fluid chamber to said second liquid refrigerant outlet and to the compressor without flowing through the evaporator.

2. A thermostatic expansion valve as set forth in claim 1 wherein said needle is moveable within said fluid chamber into a closed-position such that said first and second liquid refrigerant outlets are isolated from said liquid refrigerant inlet.

3. A thermostatic expansion valve as set forth in claim 1 wherein said needle is moveable within said fluid chamber into a partially-open position during conditions of normal refrigerant charge such that said first liquid refrigerant outlet is in fluid communication with said liquid refrigerant inlet, and such that said second liquid refrigerant outlet is isolated from said liquid refrigerant inlet.

4. A thermostatic expansion valve as set forth in claim 1 wherein said needle is moveable within said fluid chamber into a fully-open position during conditions of low refrigerant charge such that said first and second liquid refrigerant outlets are in fluid communication with said liquid refrigerant inlet.

5. A thermostatic expansion valve as set forth in claim 1 further comprising an actuation mechanism disposed adjacent said first end of said valve body for moving said needle within said fluid chamber to control the flow of the refrigerant into and out of said thermostatic expansion valve.

6. A thermostatic expansion valve as set forth in claim 5 wherein said actuation mechanism is further defined as a diaphragm for moving said needle.

7. A thermostatic expansion valve as set forth in claim 5 wherein said fluid chamber terminates at a liquid refrigerant reservoir in fluid communication with said liquid refrigerant inlet for receiving the refrigerant from the receiver, wherein said liquid refrigerant reservoir has a circumference greater than a circumference of said fluid chamber.

8. A thermostatic expansion valve as set forth in claim 7 wherein said needle comprises an actuation end engaging said actuation mechanism, a control end disposed in said liquid refrigerant reservoir, and a shank portion extending between said actuation end and said control end wherein said notch is defined within said shank portion of said needle.

9. A thermostatic expansion valve as set forth in claim 8 further comprising a sealing device disposed at said control end of said needle for controlling the flow of the refrigerant into and out of said thermostatic expansion valve.

10. A thermostatic expansion valve as set forth in claim 9 wherein a circumference of said sealing device is less than said circumference of said liquid refrigerant reservoir yet greater than said circumference of said fluid chamber.

11. A thermostatic expansion valve as set forth in claim 9 wherein said sealing device abuts said interior wall when said needle is moved into a closed-position to isolate said first and second liquid refrigerant outlets from said liquid refrigerant inlet and from said liquid refrigerant reservoir.

12. A thermostatic expansion valve as set forth in claim 9 wherein said sealing device extends at an angle from said control end of said needle to gradually control the flow of refrigerant from said liquid refrigerant reservoir into said fluid chamber as said needle is moved within said fluid chamber.

13. A thermostatic expansion valve as set forth in claim 9 wherein said sealing device is further defined as a sphere that is contoured to gradually control the flow of refrigerant from said liquid refrigerant reservoir into said fluid chamber as said needle is moved within said fluid chamber.

14. A thermostatic expansion valve as set forth in claim 1 wherein said needle comprises a first ledge and a second ledge with said notch defined therebetween.

15. A thermostatic expansion valve as set forth in claim 14 wherein said first liquid refrigerant outlet and said interior wall define an isolation shelf 58 and said second ledge of said needle abuts said isolation shelf 58 when said needle is moved into a partially-open position to isolate said second liquid refrigerant outlet from said liquid refrigerant inlet.

16. A thermostatic expansion valve as set forth in claim 1 further comprising a gaseous refrigerant inlet defined within said valve body in fluid communication with said fluid chamber such that the refrigerant can flow from the evaporator through said gaseous refrigerant inlet and into said fluid chamber.

17. A thermostatic expansion valve as set forth in claim 8 further comprising a biasing device disposed between said second end of said valve body and said control end of said needle for biasing said needle toward said actuation mechanism.

18. An air conditioning system for controlling a flow of refrigerant under conditions of normal and low refrigerant charge, said air conditioning system comprising:

a refrigerant compressor;

a condenser in fluid communication with an outlet of said compressor;

a receiver in fluid communication with an outlet of said condenser;

an evaporator in fluid communication with an outlet of said receiver and with an inlet of said compressor;

a valve body disposed between said receiver and said evaporator and between said evaporator and said compressor, said valve body comprising a first end, a second end, and an interior wall defining a fluid chamber between said ends;

a liquid refrigerant inlet defined within said valve body in fluid communication with said receiver and said fluid chamber such that the refrigerant can flow from said receiver through said liquid refrigerant inlet and into said fluid chamber;

a first liquid refrigerant outlet defined within said valve body in fluid communication with said fluid chamber and said evaporator such that the refrigerant can flow from said fluid chamber through said first liquid refrigerant outlet and to said evaporator during the conditions of normal and low refrigerant charge;

a second liquid refrigerant outlet defined within said valve body in fluid communication with said fluid chamber and said compressor such that the refrigerant can flow from said fluid chamber through said second liquid refrigerant outlet and to said compressor during the conditions of low refrigerant charge;

a needle disposed in said fluid chamber and being moveable therein to control the flow of the refrigerant into and out of said valve body during the conditions of normal and low refrigerant charge; and a notch defined within said needle extending between said liquid refrigerant inlet and said second liquid refrigerant outlet such that, during the conditions of low refrigerant charge, an amount of the refrigerant that flows into said fluid chamber from said receiver can flow through said fluid chamber to said second liquid refrigerant outlet and to said compressor without flowing through said evaporator.

19. An air conditioning system as set forth in claim 18 wherein said needle is moveable within said fluid chamber into a closed-position such that said first and second liquid refrigerant outlets are isolated from said liquid refrigerant inlet.

20. An air conditioning system as set forth in claim 18 wherein said needle is moveable within said fluid chamber into a partially-open position during conditions of normal refrigerant charge such that said first liquid refrigerant outlet is in fluid communication with said liquid refrigerant inlet, and such that said second liquid refrigerant outlet is isolated from said liquid refrigerant inlet.

21. An air conditioning system as set forth in claim 18 wherein said needle is moveable within said fluid chamber into a fully-open position during conditions of low refrigerant charge such that said first and second liquid refrigerant outlets are in fluid communication with said liquid refrigerant inlet.

22. An air conditioning system as set forth in claim 18 further comprising an actuation mechanism disposed adjacent said first end of said valve body for moving said needle within said fluid chamber to control the flow of the refrigerant into and out of said valve body.

23. An air conditioning system as set forth in claim 22 wherein said fluid chamber terminates at a liquid refrigerant reservoir in fluid communication with said liquid refrigerant inlet for receiving the refrigerant from said receiver, wherein said liquid refrigerant reservoir has a circumference greater than a circumference of said fluid chamber.

24. An air conditioning system as set forth in claim 23 wherein said needle comprises an actuation end engaging said actuation mechanism, a control end disposed in said liquid refrigerant reservoir, and a shank portion extending between said actuation end and said control end wherein said notch is defined within said shank portion of said needle.

25. An air conditioning system as set forth in claim 24 further comprising a sealing device disposed at said control end of said needle for controlling the flow of the refrigerant into and out of said valve body.

26. An air conditioning system as set forth in claim 25 wherein a circumference of said sealing device is less than said circumference of said liquid refrigerant reservoir yet greater than said circumference of said fluid chamber.

27. An air conditioning system as set forth in claim 25 wherein said sealing device abuts said interior wall when said needle is moved into a closed-position to isolate said first and second liquid refrigerant outlets from said liquid refrigerant inlet and from said liquid refrigerant reservoir.

28. An air conditioning system as set forth in claim 18 wherein said needle comprises a first ledge and a second ledge with said notch defined therebetween.

29. An air conditioning system as set forth in claim 28 wherein said first liquid refrigerant outlet and said interior wall define an isolation shelf 58 and said second ledge of said needle abuts said isolation shelf 58 when said needle is moved into a partially-open position to isolate said second liquid refrigerant outlet from said liquid refrigerant inlet.

30. An air conditioning system as set forth in claim 18 further comprising a gaseous refrigerant inlet defined within said valve body in fluid communication with said evaporator and said fluid chamber such that the refrigerant can flow from said evaporator through said gaseous refrigerant inlet and into said fluid chamber.

31. An air conditioning system as set forth in claim 18 further comprising a suction gas tube connected between said second liquid refrigerant outlet and said compressor for accommodating the flow of the refrigerant from said fluid chamber to said compressor.

32. An air conditioning system as set forth in claim 18 wherein said receiver comprises an internal wall defining an outer cavity and an inner cavity wherein said outer cavity is in fluid communication with said outlet of said condenser for receiving the refrigerant from the condenser, and said inner cavity is in fluid communication with said compressor for sending the refrigerant to the compressor.

33. An air conditioning system as set forth in claim 32 wherein said liquid refrigerant inlet is in fluid communication with said outer cavity of said receiver for receiving the refrigerant from said outer cavity into said fluid chamber.

34. An air conditioning system as set forth in claim 33 wherein said second refrigerant outlet is in fluid communication with said inner cavity of said receiver for receiving the refrigerant from said fluid chamber into said inner cavity such that, during the conditions of low refrigerant charge, an amount of the refrigerant that flows into said fluid chamber from said outer cavity can flow through said fluid chamber to said second liquid refrigerant outlet, to said inner cavity, and to said compressor without flowing through said evaporator.

35. An air conditioning system for controlling a flow of refrigerant under conditions of normal and low refrigerant charge, said air conditioning system comprising:

a refrigerant compressor;

a condenser in fluid communication with an outlet of said compressor;

an evaporator in fluid communication with an outlet of said condenser and with an inlet of said compressor;

a valve body disposed between said condenser and said evaporator and between said evaporator and said compressor, said valve body comprising a first end, a second end, and an interior wall defining a fluid chamber between said ends;

a liquid refrigerant inlet defined within said valve body in fluid communication with said condenser and said fluid chamber such that the refrigerant can flow from said condenser through said liquid refrigerant inlet and into said fluid chamber;

a first liquid refrigerant outlet defined within said valve body in fluid communication with said fluid chamber and said evaporator such that the refrigerant can flow from said fluid chamber through said first liquid refrigerant outlet and to said evaporator during the conditions of normal and low refrigerant charge;

a second liquid refrigerant outlet defined within said valve body in fluid communication with said fluid chamber and said compressor such that the refrigerant can flow from said fluid chamber through said second liquid refrigerant outlet and to said compressor during the conditions of low refrigerant charge;

a needle disposed in said fluid chamber and being moveable therein to control the flow of the refrigerant into and out of said valve body during the conditions of normal and low refrigerant charge; and a notch defined within said needle extending between said liquid refrigerant inlet and said second liquid refrigerant outlet such that, during the conditions of low refrigerant charge, an amount of the refrigerant that flows into said fluid chamber from said condenser can flow through said fluid chamber to said second liquid refrigerant outlet and to said compressor without flowing through said evaporator.

* * * * *